US010249985B2

(12) United States Patent
Miyazawa et al.

(10) Patent No.: US 10,249,985 B2
(45) Date of Patent: Apr. 2, 2019

(54) WATERPROOF CONNECTOR

(71) Applicant: YAZAKI CORPORATION, Tokyo (JP)

(72) Inventors: Yuuki Miyazawa, Shizuoka (JP); Kouki Iwakura, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/010,346

(22) Filed: Jun. 15, 2018

(65) Prior Publication Data

US 2018/0366870 A1 Dec. 20, 2018

(30) Foreign Application Priority Data

Jun. 16, 2017 (JP) ..... 2017-118312

(51) Int. Cl.

*H01R 13/58* (2006.01)
*H01R 13/52* (2006.01)
*H01R 13/50* (2006.01)
*H01R 13/04* (2006.01)

(52) U.S. Cl.

CPC ..... *H01R 13/5845* (2013.01); *H01R 13/50* (2013.01); *H01R 13/5205* (2013.01); *H01R 13/04* (2013.01)

(58) Field of Classification Search

CPC ..... H01R 13/5845; H01R 13/50; H01R 13/5205; H01R 13/04
USPC ..... 439/606
See application file for complete search history.

(56) References Cited

U.S. PATENT DOCUMENTS 5,820,399 A * 10/1998 Shirouzu ..... H01R 13/6275 439/352
6,045,390 A * 4/2000 Metz ..... H02G 3/16 439/405
6,149,472 A * 11/2000 Endo ..... H01R 13/4226 439/745
6,196,860 B1 * 3/2001 Okayasu ..... H01R 13/506 439/395
6,234,840 B1 * 5/2001 Nakata ..... H01R 13/6593 439/607.01
6,494,749 B1 * 12/2002 Chang ..... H01R 13/516 439/564

(Continued)

FOREIGN PATENT DOCUMENTS

JP 2014-17198 A 1/2014

*Primary Examiner* — Alexander Gilman
(74) *Attorney, Agent, or Firm* — Kenealy Vaidya LLP

(57) ABSTRACT

In a connector, a connector housing comprises a pair of first reinforcing ribs and a pair of second reinforcing ribs. The first reinforcing ribs are disposed on the connector fitting portion, extend along an extending direction of a mold portion of the connector housing, and are arranged along a direction perpendicular to the extending direction. A width between the first reinforcing ribs is substantially the same as a width of a terminal, a part of which is buried in the mold portion. The second reinforcing ribs are disposed on the mold portion, extend along the extending direction, and are arranged along the direction perpendicular to the extending direction. Height positions of tip end surfaces of the second reinforcing ribs are set to be substantially the same as a high position of an outer surface of the mold portion formed in a place where a seal member is disposed.

2 Claims, 7 Drawing Sheets

(56) References Cited

U.S. PATENT DOCUMENTS

| | | | | |
|---|---|---|---|---|
| 6,699,075 | B1 * | 3/2004 | Ko | H01R 9/032 439/607.48 |
| 6,948,977 | B1 * | 9/2005 | Behrent | H01R 23/688 439/581 |
| 7,393,218 | B1 * | 7/2008 | Pavlovic | H01R 4/646 439/939 |
| 7,465,185 | B2 * | 12/2008 | Tyler | H01R 13/506 439/352 |
| 7,553,191 | B2 * | 6/2009 | Su | H01R 13/5845 439/497 |
| 8,057,261 | B1 * | 11/2011 | DeSio | H01R 13/506 439/625 |
| 8,353,724 | B2 * | 1/2013 | Shi | H01R 13/5812 439/540.1 |
| 9,118,127 | B2 * | 8/2015 | Matsunaga | H01R 13/10 |
| 9,960,535 | B2 * | 5/2018 | Kida | H01R 13/5219 |
| 2003/0157835 | A1 * | 8/2003 | Ishikawa | H01R 13/4223 439/595 |
| 2005/0176298 | A1 * | 8/2005 | Flowers | H01R 13/4365 439/595 |
| 2005/0186842 | A1 * | 8/2005 | Fukatsu | H01R 13/4223 439/595 |
| 2009/0269977 | A1 * | 10/2009 | Chen | H01R 13/518 439/540.1 |
| 2014/0364005 | A1 * | 12/2014 | Yagi | H01R 13/4223 439/595 |
| 2015/0214655 | A1 * | 7/2015 | Mori | H01R 13/504 439/606 |

* cited by examiner

<COMPARATIVE EXAMPLE>

WATERPROOF CONNECTOR

CROSS-REFERENCES TO RELATED APPLICATIONS

This application is based on and claims priority from Japanese Patent Application No. 2017-118312 filed on Jun. 16, 2017, the entire contents of which are incorporated herein by reference.

FIELD

One or more embodiments of the present invention relate to a connector in which an electrical connection portion formed by molding is buried in a connector housing.

BACKGROUND

For example, an inverter unit and a battery, and the inverter and a motor unit mounted in a hybrid vehicle or an electric vehicle are electrically connected by a high-voltage wire harness. A waterproof connector is provided at the terminal of the wire harness.

In the related art, there is known a technique of the connector (for example, see JP-A-2014-17198). A connector illustrated in FIGS. 1 and 2 of JP-A-2014-17198 includes a terminal connected to a terminal portion of a coated wire, a seal portion made of an insulating elastic material, and a housing made of an insulating resin. The seal portion is formed to integrally cover adjacent portions of a plurality of the juxtaposed terminals and sheaths of the coated wires, and connects these components through a connection portion. The housing is molded to cover the entire seal portion in the terminal portion of the coated wire.

SUMMARY

Incidentally, as described in the related art, the electric wire is bent in the connector in which the electrical connection portion is buried in the connector housing by molding. Therefore, there is a concern in that the connector housing is damaged.

One or more embodiments of the invention have been made in view of the above circumstance, and an object thereof is to provide a connector which is capable of preventing damage of a connector housing due to wire bending.

In a first aspect of the invention, there is provided a connector including: a terminal which includes an electrical contact portion, an intermediate portion, and a conductor connecting portion, is bent at the intermediate portion to be formed to have a substantially L shape in cross section, and is connected to an end of an electric wire via the conductor connecting portion; a connector housing including a connector fitting portion in which the electrical contact portion is provided and which is fitted to a counterpart connector, and a mold portion which is formed to be continuous to the connector fitting portion and is in which a predetermined range including the intermediate portion of the terminal and an insulating sheath of the end of the electric wire as a molding target portion is buried; and a seal member which is disposed in the insulating sheath of the end of the electric wire as the molding target portion and is to prevent moisture from intruding the conductor connecting portion from an outside of the connector housing, wherein the connector housing includes a pair of first reinforcing ribs and a pair of second reinforcing ribs, wherein the pair of first reinforcing ribs are disposed opposite to a side of the connector fitting portion to be fitted to the counterpart connector, extend along an extending direction of the mold portion, and are arranged along a direction perpendicular to the extending direction of the mold portion, wherein the pair of first reinforcing ribs are formed such that a width between the pair of first reinforcing ribs is substantially the same as a width of the terminal, wherein the pair of second reinforcing ribs are disposed on a side of the mold portion to be continuous to the connector fitting portion, the side being a side facing the counterpart connector when the connector fitting portion is fitted to the counterpart connector, extend along the extending direction of the mold portion, and are arranged along the direction perpendicular to the extending direction of the mold portion, and wherein height positions of tip end surfaces of the pair of second reinforcing ribs are set to be substantially the same as a high position of an outer surface of the mold portion formed in a place where the seal member is disposed.

According to the first aspect of the invention, the pair of first reinforcing rib are provided in the connector fitting portion, and the pair of second reinforcing rib are provided in the mold portion. Therefore, an external force due to stress on wire bending can be prevented.

The width between the pair of first reinforcing ribs is set to be substantially the same as that of the terminal, and the height positions of the tip end surfaces of the pair of second reinforcing rib are set to be substantially the same as the high position of the outer surface of the mold portion which is formed in a place of the seal member. Therefore, the connector is not increased in size compared to the connector housing which only causes thickening, and the molded connector housing is hardly deformed.

In a second aspect of the invention, there is provided the connector according to the first aspect, wherein the connector fitting portion includes a first coupling rib which extends along the direction perpendicular to the extending direction of the mold portion and couples the pair of first reinforcing ribs to each other, and wherein the mold portion includes a second coupling rib which extends along the direction perpendicular to the extending direction of the mold portion and couples the pair of second reinforcing ribs to each other.

According to the second aspect of the invention, the first coupling rib extends along the direction perpendicular to the extending direction of the mold portion, and is provided to couple the first reinforcing ribs to each other. The second coupling rib extends in the direction perpendicular to the extending direction of the mold portion, and is provided to couple the second reinforcing ribs to each other. Therefore, an external force due to stress on the wire bending is further prevented.

According to one or more embodiments of the invention, an external force due to stress on wire bending is prevented, so that it is possible to prevent damage of the connector housing caused by the wire bending.

DETAILED DESCRIPTION

Hereinafter, a connector according to an embodiment of the invention will be described with reference to FIGS. 1 to 4.

Figure 1:
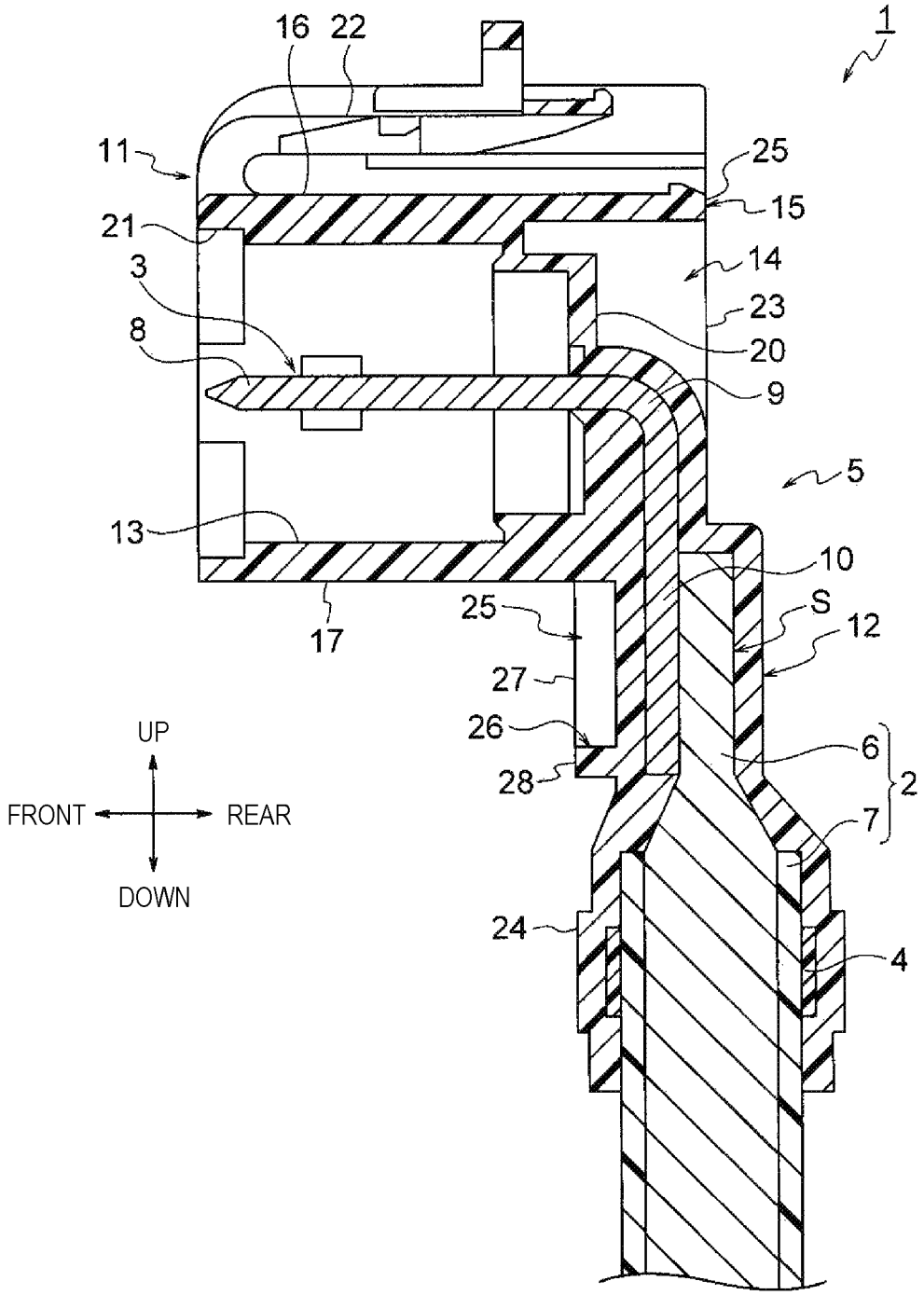
FIG. 1 is a cross-sectional view illustrating a connector according to an embodiment of the invention.
Figure 2:
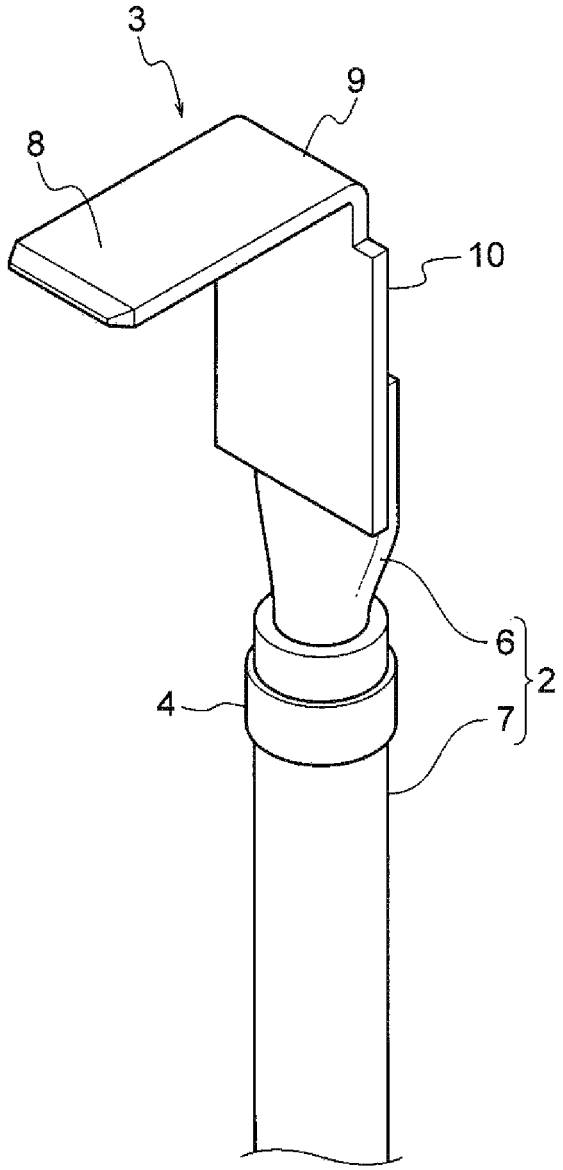
FIG. 2 is a perspective view of a high-voltage wire and a terminal.
Figure 3:
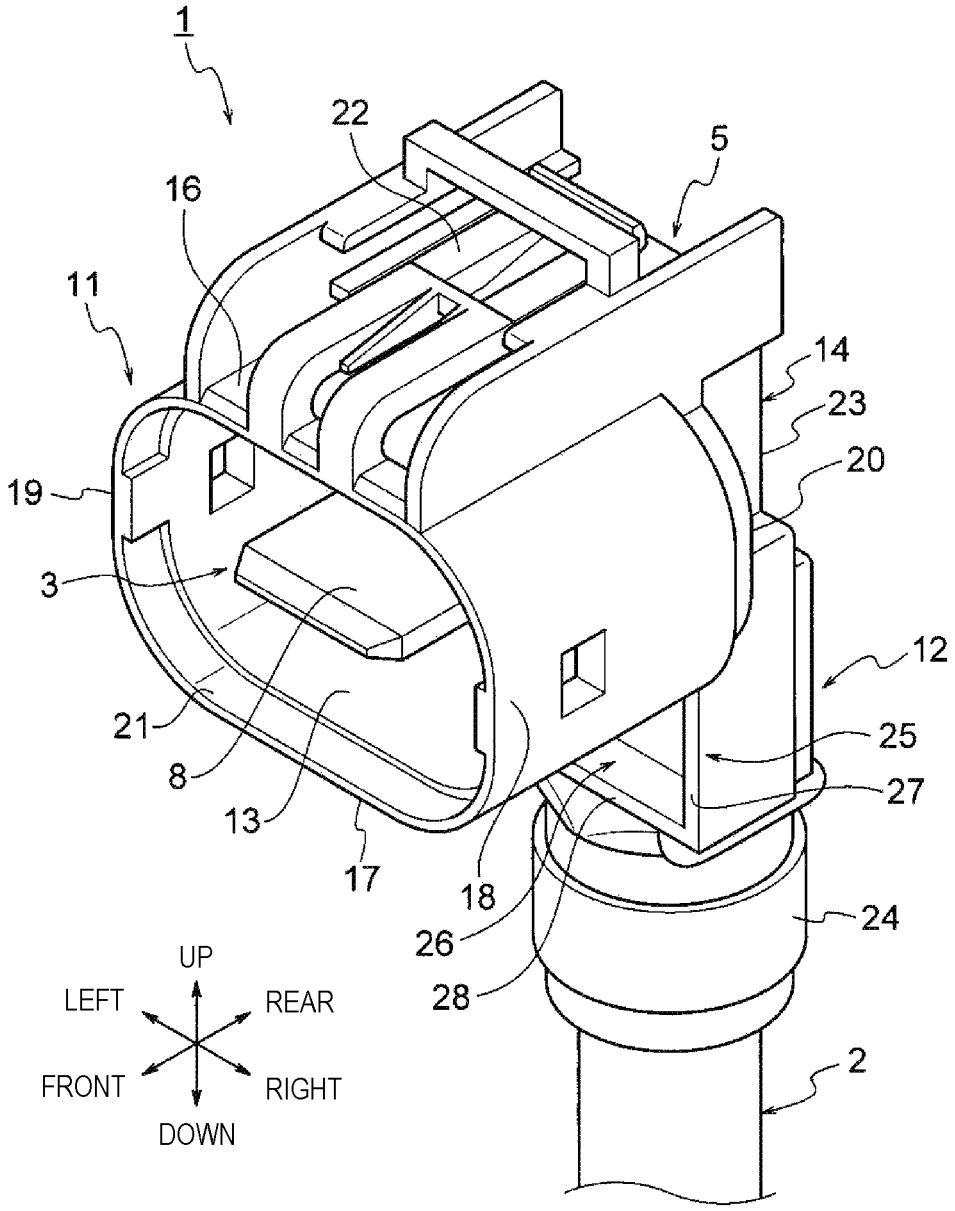
FIG. 3 is a perspective view of the connector.
Figure 4:
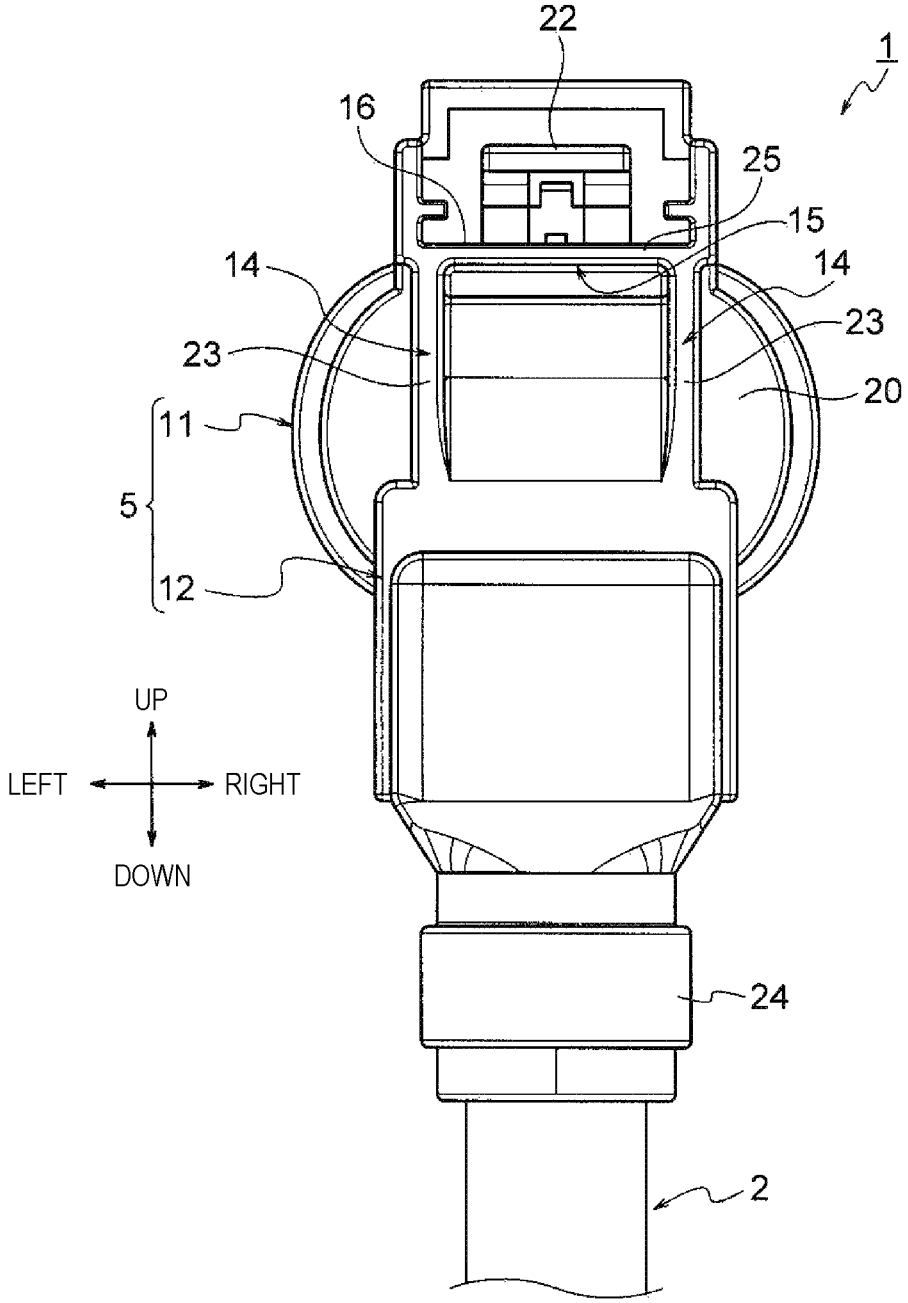
FIG. 4 is a rear view of the connector.

FIG. 1 is a cross-sectional view illustrating the connector according to the embodiment of the invention. FIG. 2 is a perspective view of a high-voltage wire and a terminal. FIG. 3 is a perspective view of the connector. FIG. 4 is a rear view of the connector.

Arrows in the drawings indicate directions of up and down, right and left, and front and rear (the respective directions of the arrows are exemplary).

In FIG. 1, the reference numeral 1 indicates the connector according to the embodiment of the invention (see FIG. 3 for an external appearance of a sealed connector). A connector 1 is configured to be fitted to a counterpart connector (not illustrated). The connector 1 includes a high-voltage wire 2, a terminal 3, a seal member 4, and a connector housing 5. Hereinafter, the configurations of the connector 1 will be described.

First, the high-voltage wire 2 will be described.

The high-voltage wire 2 illustrated in FIGS. 1 and 2 corresponds to an "electric wire" in claims. The high-voltage wire 2 is a high-voltage conduction path to electrically connect an inverter unit and a motor unit mounted in a vehicle (not illustrated) for example. The high-voltage wire 2 includes a conductor 6 and an insulating sheath 7 which covers the conductor 6 as illustrated in FIGS. 1 and 2. The insulating sheath 7 at an end of the high-voltage wire 2 is removed by a predetermined length to expose the conductor 6.

Next, the terminal 3 will be described.

The terminal 3 illustrated in FIGS. 1 and 2 is formed by pressing a copper or copper-alloyed metal plate. The terminal 3 is formed in a substantially strip plate shape in this embodiment. The terminal 3 includes an electrical contact portion 8, an intermediate portion 9, and a conductor connecting portion 10 as illustrated in FIGS. 1 and 2. The terminal 3 is bent at the intermediate portion 9 such that the cross section thereof becomes a substantially L shape as illustrated in FIG. 1.

The electrical contact portion 8 is a portion to be connected to a counterpart terminal (not illustrated) and is formed in a tab shape as illustrated in FIGS. 1 and 2. The electrical contact portion 8 is disposed in a connector fitting portion 11 of the connector housing 5 to be described below. In this embodiment, the electrical contact portion 8 is a male mold, but may be formed as a female mold. In this case, the electrical contact portion 8 is formed in a box shape for example.

The intermediate portion 9 is formed to couple the electrical contact portion 8 and the conductor connecting portion 10 in the middle of the terminal 3 as illustrated in FIGS. 1 and 2. The intermediate portion 9 is a portion in which the terminal 3 is bent to have a cross section of a substantially L shape as illustrated in FIG. 1.

The conductor connecting portion 10 is formed in a plate shape as illustrated in FIGS. 1 and 2. In the conductor connecting portion 10, the conductor 6 of the end of the high-voltage wire 2 is electrically connected. In this embodiment, the conductor 6 is welded and connected in a crushed state (which is an example, and other connection methods may be employed).

Next, the seal member 4 will be described.

The seal member 4 illustrated in FIGS. 1 and 2 is provided as a member to prevent moisture from intruding the electrical connection portion from the outside of the connector housing 5. Specifically, the seal member 4 is provided as a member to prevent moisture from intruding a connection portion between the conductor connecting portion 10 of the terminal 3 and the conductor 6 of the high-voltage wire 2. The seal member 4 is disposed in the insulating sheath 7 of the end of the high-voltage wire 2. The seal member 4 is formed in a strip shape, and is wound around the insulating sheath 7 of the end of the high-voltage wire 2.

Next, the connector housing 5 will be described.

The connector housing 5 illustrated in FIGS. 1, 3, and 4 is molded of a conductive synthetic resin material. The connector housing 5 includes the connector fitting portion 11 and a mold portion 12 which is formed to be continuous to the connector fitting portion 11 and extends in a direction perpendicular to an axial direction of the connector fitting portion 11.

As illustrated in FIGS. 1 and 3, the connector fitting portion 11 is a portion to be fitted to the counterpart connector (not illustrated), and is formed in a box shape. The connector fitting portion 11 includes an upper surface 16, a lower surface 17, a left side surface 18, a right side surface 19, and a rear surface 20 as illustrated in FIGS. 1 and 3. On the front end side, an opening 21 is formed. The connector fitting portion 11 includes a connector fitting chamber 13 which is formed to be communicated to the opening 21 therein as illustrated in FIGS. 1 and 3. The electrical contact portion 8 of the terminal 3 is disposed in the connector fitting chamber 13.

As illustrated in FIGS. 1 and 3, the connector fitting portion 11 is provided with an engagement arm 22 in the upper surface 16 to be engaged to the counterpart connector.

As illustrated in FIGS. 1, 3, and 4, the connector fitting portion 11 is provided with a pair of first reinforcing ribs 14 and a first coupling rib 15, which couples the first reinforcing ribs 14 to each other, in the rear surface 20 (a surface corresponding to the opposite side to the surface to be fitted to the counterpart connector).

As illustrated in FIG. 4, the pair of first reinforcing ribs 14 are formed along an extending direction (a vertical direction in FIG. 4) of the mold portion 12 to extend from a position where the upper surface 16 and the rear surface 20 of the connector fitting portion 11 are connected up to a position where the connector fitting portion 11 and the mold portion 12 are connected. As illustrated in FIG. 4, the pair of first reinforcing ribs 14 are arranged along a direction (a right and left direction in FIG. 4) perpendicular to the extending direction of the mold portion 12.

The first reinforcing ribs 14 illustrated in FIG. 4 are formed such that the width between the first reinforcing ribs 14 is substantially the same as that in the lateral direction of the terminal 3 (the bent intermediate portion 9). As illustrated in FIG. 1, the first reinforcing ribs 14 are formed such that a tip end surface 23 does not protrude to the rear side from an outer surface 24 of the mold portion 12.

As illustrated in FIG. 4, the first coupling rib 15 extends along the direction (the right and left direction in FIG. 4) perpendicular to the extending direction of the mold portion 12, and is formed to couple the upper ends of the first reinforcing ribs 14 to each other. The first coupling rib 15 is formed such that the height position of a tip end surface 23 is substantially the same as that of the tip end surface 23 of the first reinforcing rib 14.

The mold portion 12 illustrated in FIGS. 1, 3, and 4 is formed to be continuous to a portion from a substantially intermediate portion of the rear surface 20 of the connector fitting portion 11 up to the rear end side of the lower surface 17 of the connector fitting portion 11. Further, the mold portion 12 is formed to extend in a direction (the vertical direction in FIGS. 1, 3, and 4) perpendicular to the axial direction of the connector fitting portion 11.

As illustrated in FIG. 1, the mold portion 12 is formed by burying a predetermined range including the intermediate portion 9 of the terminal 3 and the insulating sheath 7 of the end of the high-voltage wire 2 as a molding target portion S. The mold portion 12 is formed as a solid portion which is formed in a predetermined shape.

As illustrated in FIGS. 1 and 3, the mold portion 12 includes a pair of second reinforcing ribs 25 and a second coupling rib 26, which couples the second reinforcing ribs 25 to each other, on a side of the mold portion 12 to be continuous to the connector fitting portion 11, the side being a side facing the counterpart connector (not illustrated) when the connector fitting portion 11 is fitted to the counterpart connector.

As illustrated in FIGS. 1 and 3, the pair of second reinforcing ribs 25 are formed to extend from the position where the lower surface 17 of the connector fitting portion 11 and the mold portion 12 are connected up to a substantially intermediate portion of the mold portion 12 along the extending direction (the vertical direction in FIGS. 1 and 3) of the mold portion 12. The pair of second reinforcing ribs 25 are arranged along the direction (the right and left direction in FIG. 3) perpendicular to the extending direction of the mold portion 12.

The second reinforcing rib 25 illustrated in FIG. 1 is formed such that the height position of a tip end surface 27 is located at substantially the same position as that of the outer surface 24 of the mold portion 12 which is formed in a place of the seal member 4. As illustrated in FIG. 1, the second reinforcing rib 25 is formed such that the tip end surface 27 does not protrude to the front side from the outer surface 24 of the mold portion 12.

As illustrated in FIGS. 1 and 3, the second coupling rib 26 extends along a direction (the right and left direction in FIG. 3) perpendicular to the extending direction of the mold portion 12, and is formed to couple the lower ends of the second reinforcing ribs 26 to each other. The second coupling rib 26 is formed such that the height position of a tip end surface 28 is located at substantially the same position as that of the tip end surface 27 of the second reinforcing rib 25.

Next, manufacturing procedures (work) of the connector 1 will be described based on the configurations and the structures described above.

In a first procedure, the conductor 6 of the end of the high-voltage wire 2 illustrated in FIG. 2 is connected to the conductor connecting portion 10 of the terminal 3. As the connection method, welding, melting and fixing, soldering, and the like may be employed. In this embodiment, the connection is made by the welding.

In a second procedure, the seal member 4 is provided in the insulating sheath 7 of the end of the high-voltage wire 2 illustrated in FIG. 2. The seal member 4 is provided by winding.

In a third procedure, the connector housing 5 illustrated in FIG. 3 is molded with resin. The resin molding is performed in a state where the terminal 3 connected to the end of the high-voltage wire 2 is set in a metal mold of the connector housing 5. The connector housing 5 is molded with resin to fill the molding target portion S illustrated in FIG. 1.

In the resin molding, the first reinforcing ribs 14, the first coupling rib 15, the second reinforcing ribs 25, and the second coupling rib 26 are formed in the connector housing 5. In this embodiment, the first reinforcing ribs 14, the first coupling rib 15, the second reinforcing ribs 25, and the second coupling rib 26 are configured and structured as described above. Therefore, the connector 1 is not increased in size compared to the connector housing which only causes thickening. Further, the connector housing 5 is hardly deformed. As described above, the manufacturing procedures (work) of the connector 1 are completed.

Next, the description will be given about results obtained by comparing bending amounts when the same external force is applied to the connector housing 5 of the connector 1 according to this embodiment and a connector housing 105 of the connector according to a comparative example with reference to FIGS. 5 to 7.

Figure 5:
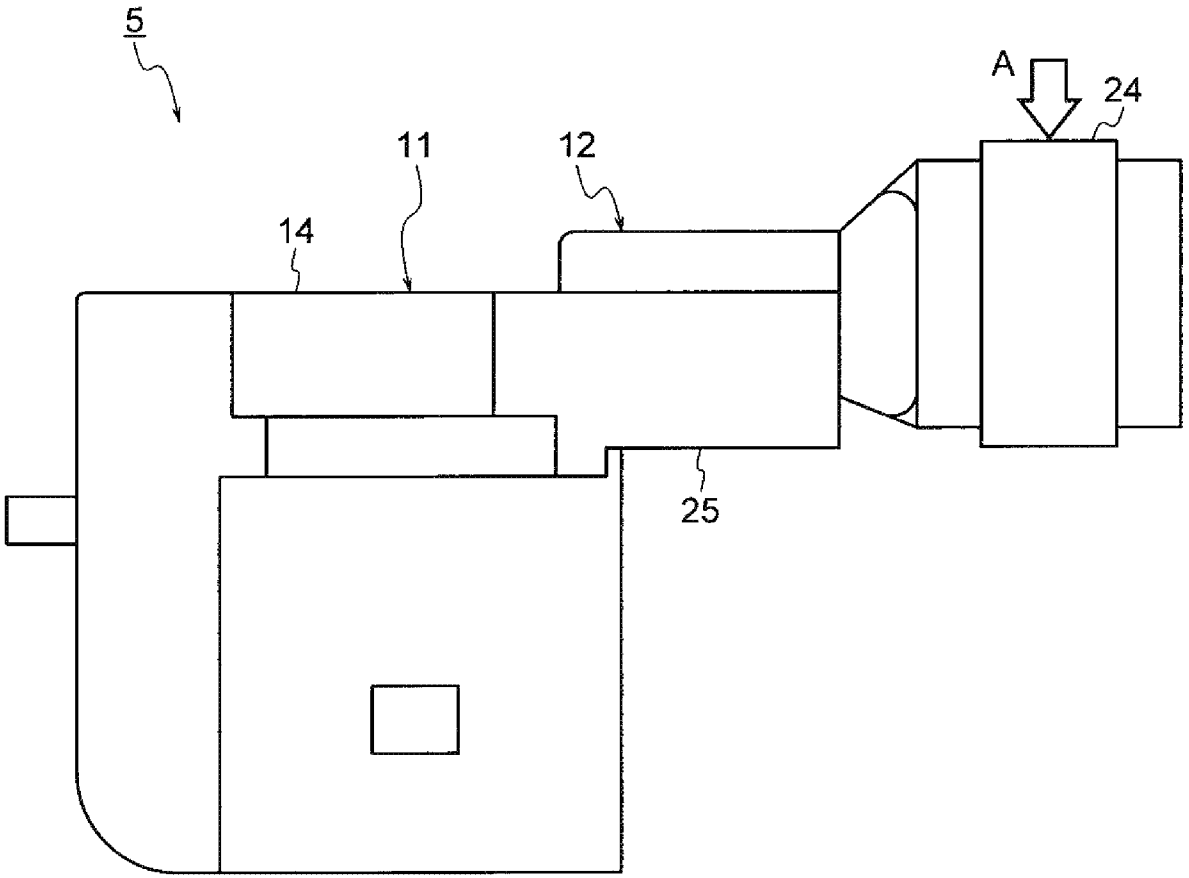
FIG. 5 is a side view illustrating a state before an external force is applied to a connector housing.

FIG. 5 is a side view illustrating a state before the external force is applied to the connector housing according to this embodiment. FIG. 6 is a perspective view illustrating a state where the external force is applied to the connector housing. FIG. 7 is a perspective view illustrating a state where the external force is applied to the connector housing according to the comparative example.

Arrows in the drawings indicate the vertical direction (the respective directions of arrows are given as exemplary).

First, this embodiment will be described.

First, the tip end side of the connector fitting portion 11 of the connector housing 5 illustrated in FIG. 5 is fixed. A predetermined external force is applied to the end side of the mold portion 12 (a portion indicated by the reference numeral 24 (the outer surface) in FIG. 5) toward a direction indicated by an arrow A. Then, in the connector housing 5 illustrated in FIG. 6, the end side (a portion indicated by the reference numeral 24 (the outer surface) in FIG. 6) of the mold portion 12 is to be bent to the lower direction.

Herein, the connector housing 5 is provided with the first reinforcing rib 14 and the second reinforcing rib 25. Therefore, it is possible to prevent that the end side of the mold portion 12 is bent to the lower direction. For this reason, it can be seen that the connector housing 5 is hardly damaged even when the external force is applied to the end side of the mold portion 12.

Next, the comparative example will be described.

The connector housing 105 (see FIG. 7) of the connector according to the comparative example is not provided with the second reinforcing rib 25 (see FIG. 6) in this embodiment.

Figure 7:
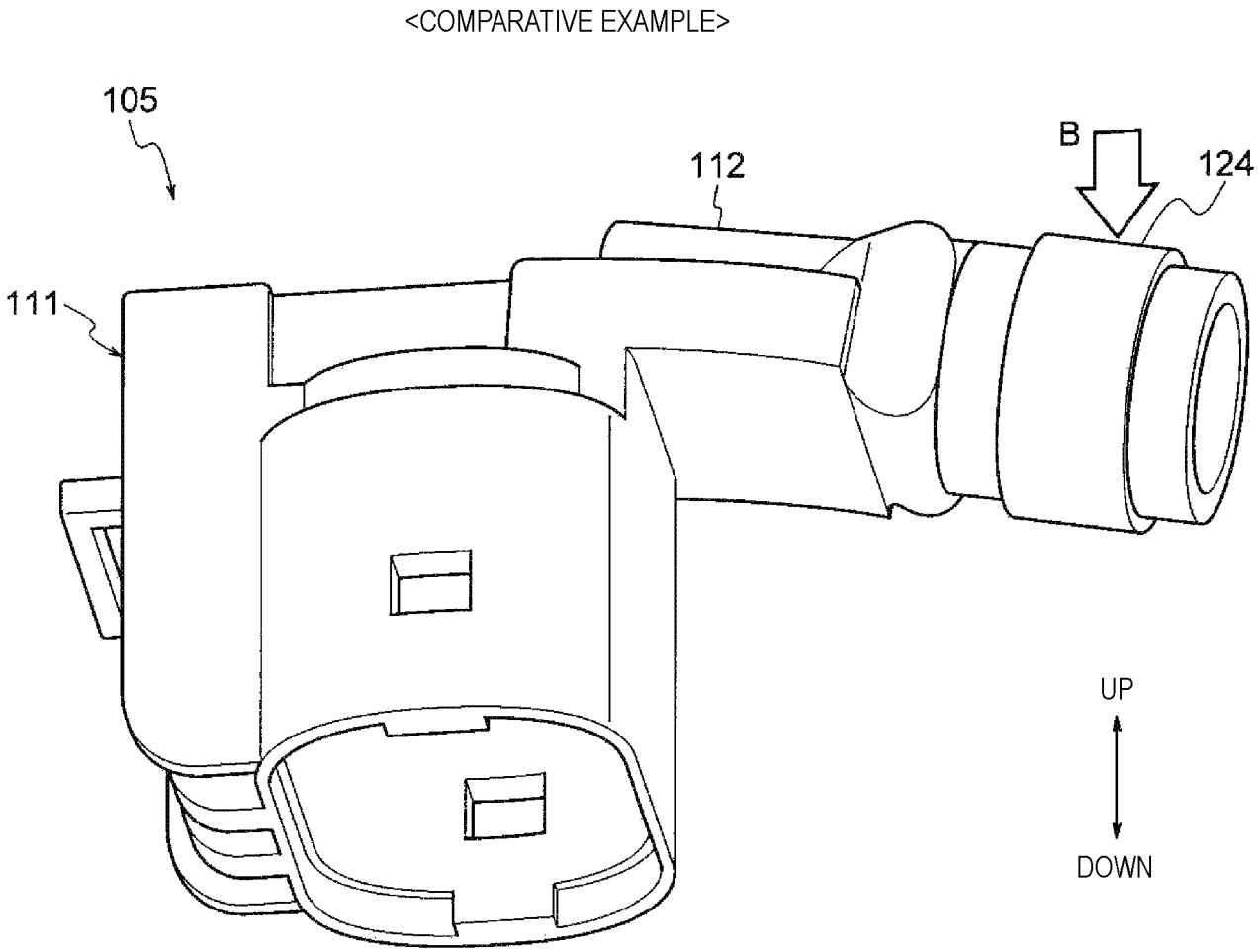
FIG. 7 is a perspective view illustrating a state where the external force is applied to a connector housing in a comparative example.

First, the tip end side of a connector fitting portion 111 of the connector housing 105 illustrated in FIG. 7 is fixed. A predetermined external force is applied to the end side (a portion indicated by the reference numeral 124 (the outer surface) in FIG. 7) of a mold portion 112 toward a direction indicated by an arrow B. The external force has the same magnitude as that of the external force applied to the connector housing 5 in this embodiment. Then, in the connector housing 105 illustrated in FIG. 7, the end side of the mold portion 112 is to be bent to the lower direction.

Herein, the connector housing 105 is not provided with the second reinforcing rib 25 (see FIG. 6) in this embodiment. Therefore, the end side of the mold portion 112 is hard to be prevented from being bent to the lower direction compared to the connector housing 5 in this embodiment.

Figure 6:
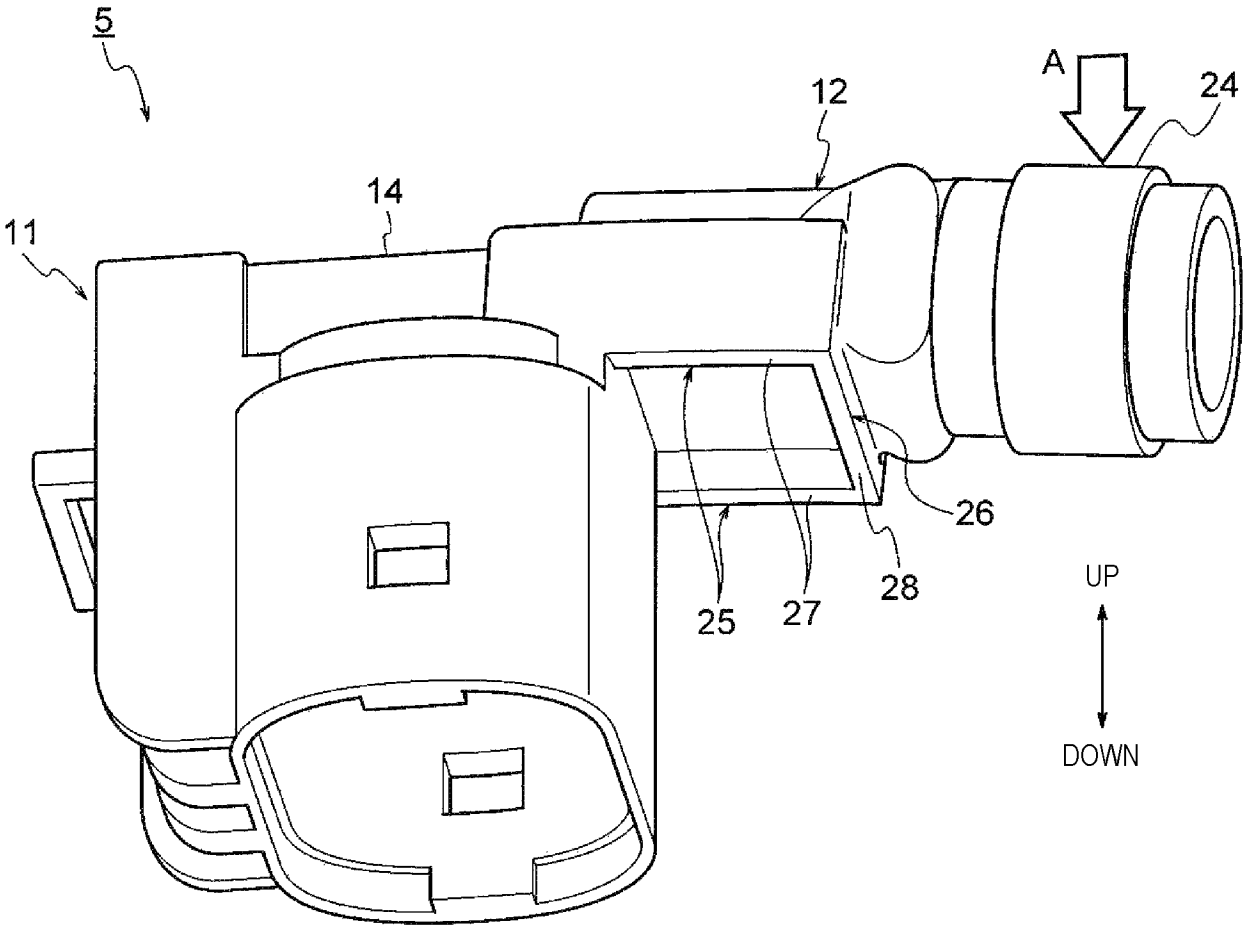
FIG. 6 is a perspective view illustrating a state where the external force is applied to the connector housing.

Therefore, in the connector housing 105, the end side of the mold portion 112 is bent to the lower direction in larger amount as compared to the case where the end side of the mold portion 12 of the connector housing 5 is bent to the lower direction (see FIGS. 6 and 7). Therefore, it can be seen that the connector housing 105 is easily damaged compared to the connector housing 5 when the external force is applied to the end side of the mold portion 112.

From the above description, when the same external force is applied to the connector housing 5 in this embodiment and the connector housing 105 in the comparative example, the connector housing 5 in this embodiment is hardly bent compared to the connector housing 105 in the comparative example as described above. Therefore, it can be seen that the connector housing 5 of the connector 1 in this embodiment is hard to be damaged compared to the connector housing 105 in the comparative example.

Next, effects of the connector 1 will be described.

Hitherto, according to the connector 1 described with reference to FIGS. 1 to 6, the external force due to stress on wire bending is prevented. Therefore, it is possible to prevent the damage of the connector housing 5 caused by the wire bending.

Further, it is a matter of course that various modifications can be made within a scope not departing from the scope of the invention.

The invention claimed is:

1. A connector comprising:

a terminal which comprises an electrical contact portion, an intermediate portion, and a conductor connecting portion, is bent at the intermediate portion to be formed to have a substantially L shape in cross section, and is connected to an end of an electric wire via the conductor connecting portion;

a connector housing comprising a connector fitting portion in which the electrical contact portion is provided and which is fitted to a counterpart connector, and a mold portion which is formed to be continuous to the connector fitting portion and is in which a predetermined range comprising the intermediate portion of the terminal and an insulating sheath of the end of the electric wire as a molding target portion is buried; and a seal member which is disposed in the insulating sheath of the end of the electric wire as the molding target portion and is to prevent moisture from intruding the conductor connecting portion from an outside of the connector housing, wherein the connector housing comprises a pair of first reinforcing ribs and a pair of second reinforcing ribs, wherein the pair of first reinforcing ribs are disposed opposite to a side of the connector fitting portion to be fitted to the counterpart connector, extend along an extending direction of the mold portion, and are arranged along a direction perpendicular to the extending direction of the mold portion, wherein the pair of first reinforcing ribs are formed such that a width between the pair of first reinforcing ribs is substantially the same as a width of the terminal, wherein the pair of second reinforcing ribs are disposed on a side of the mold portion to be continuous to the connector fitting portion, the side being a side facing the counterpart connector when the connector fitting portion is fitted to the counterpart connector, extend along the extending direction of the mold portion, and are arranged along the direction perpendicular to the extending direction of the mold portion, and wherein height positions of tip end surfaces of the pair of second reinforcing ribs are set to be substantially the same as a high position of an outer surface of the mold portion formed in a place where the seal member is disposed.

2. The connector according to claim 1, wherein the connector fitting portion comprises a first coupling rib which extends along the direction perpendicular to the extending direction of the mold portion and couples the pair of first reinforcing ribs to each other, and wherein the mold portion comprises a second coupling rib which extends along the direction perpendicular to the extending direction of the mold portion and couples the pair of second reinforcing ribs to each other.

* * * * *